United States Patent [19]

Leggett et al.

[11] Patent Number: 4,886,115

[45] Date of Patent: Dec. 12, 1989

[54] WIRELINE SAFETY MECHANISM FOR WIRELINE TOOLS

[75] Inventors: Henry H. Leggett; Howard R. Kitney, both of Singapore, Singapore

[73] Assignee: Eastern Oil Tools PTE Ltd., Singapore, Singapore

[21] Appl. No.: 257,693

[22] Filed: Oct. 14, 1988

[51] Int. Cl.[4] ..... E21B 29/04; E21B 23/02; E21B 34/14

[52] U.S. Cl. ..... 166/77; 166/217; 166/385

[58] Field of Search ..... 166/54.5, 54.6, 55.2, 166/75.1, 332, 99, 301, 376, 377, 385, 77; 30/92

[56] References Cited

U.S. PATENT DOCUMENTS

| | | | |
|---|---|---|---|
| 2,943,682 | 7/1960 | Ingram, Jr. et al. | 166/77 |
| 3,435,895 | 4/1969 | Lee | 166/75.1 |
| 3,926,252 | 12/1975 | Ribeyre et al. | 166/54.6 |
| 4,046,191 | 9/1977 | Neath | 166/75.1 X |
| 4,237,972 | 12/1970 | Lanmon, II | 166/54.5 |
| 4,299,280 | 11/1981 | Greer | 166/75.1 |
| 4,512,411 | 4/1985 | Pringle | 166/54.5 |
| 4,660,635 | 4/1987 | Wittrisch | 166/54.5 |

*Primary Examiner*—Stephen J. Novosad

*Attorney, Agent, or Firm*—James L. Jackson & Assoc.

[57] ABSTRACT

A pressure containing wireline safety mechanism for wireline assemblies incorporates a tubular body for attachment between the lubricators and stuffing box of the wireline assembly. An inner housing is releasably retained within the tubular body and is provided with a wireline cutter to cut the wireline and release a wireline tool string that is stuck in a position blocking closure of the wellhead saftey valves and the wireline blowout preventor. The inner housing also incorporates a valve mechanism that automatically forms a pressure containing seal after the wireline has been cut to thus permit the stuffing box to be removed and another wireline assembly installed above the first wireline assembly for removing the inner housing and releasing the stuck wireline tool string.

23 Claims, 4 Drawing Sheets

WIRELINE SAFETY MECHANISM FOR WIRELINE TOOLS

FIELD OF THE INVENTION

This invention relates generally to wireline equipment such as is typically utilized to place and retrieve downhole tools in wells for conducting various downhole operations. More particularly, the present invention relates to a mechanism for severing the wireline of a downhole wireline tool in the event the downhole tool should become stuck in a position preventing closure of the safety valves of a wellhead assembly. Even further, the present invention is directed to the safety apparatus for wireline equipment which is capable of automatically providing an internal pressure containing seal under circumstances where it becomes necessary to sever the wireline of the wireline tool.

BACKGROUND OF THE INVENTION

During wireline operations for conducting downhole activities in deep wells such as wells for producing petroleum products, it is a standard safety procedure to mount a wireline blowout preventer at the bottom of the pressure control system of a wireline tool that is connected to the wellhead system. The wireline blowout preventer allows pressure to be contained within the well with the wireline in place, by closing one or more pairs of rams around the wireline. Above the blowout preventer wireline equipment typically employs upper and lower lubricators that are interconnected by means of a union and a stuffing box that maintains a pressure containing seal about the wireline as it is moved into or from the wireline equipment. The upper portion of the wireline tool is typically provided with a wireline pulley that directs the running portion of the wireline downwardly to the winch of wireline handling apparatus located at or about the level of the ground or working floor about the wellhead. A downhole tool string is connected to the wireline and is typically capable of descending through the well tubing by gravity or by pressure induced force such that it moves downwardly within the well to the level of working operations. After working operations have been completed, the tool string is withdrawn upwardly through the well tubing by force applied to the wireline by the wireline winch. In some cases, the tool string is propelled upwardly through the tubing string by means of pressure induced force so that the wireline is used only for purposes of control and for insuring positioning of the tool string at the appropriate level within the well.

As the wireline tool string reaches the upper limits of its travel it traverses the vertical flow passage of the wellhead. Occasionally a tool string is moved upwardly sufficiently fast that it impacts against internal structure of the wellhead or wireline equipment and under such circumstances, the tool string can become stuck in a position preventing closure of the wireline blowout preventer and also preventing closure of the wellhead safety valves such as the top and bottom master valves. When this occurs, it is impossible to return the wellhead system to a safe condition unless the wireline tool string can be moved downwardly or upwardly to a position clearing at least one of the safety valves of the wellhead or blowout preventer. Different jarring mechanisms are typically employed in this case to release the tool string from its stuck position; however, if the jars fail to release the wireline tool from its stuck position it may be impossible to safely shut-in the well without necessitating killing it. Obviously it is quite expensive to kill a well simply to assure safe removal of a stuck wireline tool string. This can cause severe damage to the well and can be detrimental to the production of the well once it is restored to producing condition. It is desirable, therefore, to provide an efficient mechanism for rendering wireline equipment to a safe condition to thus enable a stuck wireline tool string to be safely released from a stuck condition and so that the well may be efficiently shut-in for completion of wireline service activities.

It is a principal feature of the present invention to provide a novel mechanism for wireline equipment which is capable of severing the wireline of a stuck wireline tool string to thereby release the connection between the wireline and the wireline tool string.

It is also a feature of the present invention to provide a novel mechanism for automatically developing an internal safety seal within the wireline equipment when the wireline is severed such that additional wireline equipment may be assembled in end-to-end relation to the wireline equipment initially in use and which is provided with another wireline tool that is capable of accomplishing release and handling of a stuck wireline tool string.

It is an even further feature of the present invention to provide wireline equipment having the capability of severing the wireline and developing an internal safety seal and also being capable of being rendered to a completely open condition to thus provide for passage of another wireline tool string through the housing of the wireline equipment for achieving service and handling operations with respect to a stuck wireline tool string.

SUMMARY OF THE INVENTION

According to the present invention a wireline safety mechanism is interconnected with wireline equipment such that it is located above the lubricator, or above the upper lubricator where upper and lower lubricators are employed, and below the stuffing box of the wireline equipment. The wireline safety mechanism incorporates an internal cutting device for severing the wireline, which device is operable only under specific circumstances and as a result of selected control and operation. Additionally, the mechanism incorporates an internal safety valve that is automatically moved to its closed position simultaneously with severing of the wireline to thereby contain any well pressure and thereby permit the stuffing box of the wireline equipment to be safely removed. With the stuffing box removed, another wireline assembly will then be connected to the upper end of the safety mechanism. The stuffing box is then relocated to the upper end of the uppermost wireline assembly and a tool string of the upper wireline assembly is then utilized to release the stuck wireline tool string from within the wellhead. Typically, the wireline tool string of the uppermost wireline assembly will incorporate a fishing tool that is capable of grasping the fishing neck of the safety apparatus and applying upward force to withdraw the entire safety apparatus upwardly through a valve assembly such as a ball or gate valve that will then provide an effective seal for the lower wireline equipment. After the internal components of the safety mechanism have been withdrawn into the lubricator of the upper wireline equipment, the valve may be closed and the upper wireline equipment disassembled from the valve so that the internal safety components can be removed from the upper wireline equipment. An appropriate wireline tool string such as a latch and jarring device is then utilized to latch onto the upper end of the stuck wireline tool string and achieve its effective release from its stuck condition.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

In the Drawings

FIG. 1 is an elevational view of the wellhead of a well having a wireline assembly and wireline blowout preventer connected to the upper portion thereof and wherein the wireline assembly incorporates a wireline cutter and safety mechanism constructed in with the present invention;

FIG. 2 is an elevational view similar to that of FIG. 1 and showing second wireline equipment and pressure control valve interconnected to the upper end of the wireline cutter and safety mechanism of the present invention;

FIG. 3 is an elevational view similar to that of FIG. 2 and showing in broken lines the use of an additional wireline equipment for releasing a stuck wireline toolstring of the lower wireline equipment mechanism;

FIGS. 4A and 4B are sectional views respectively illustrating the upper and lower portions of the wireline safety apparatus of the present invention, with the internal components thereof positioned during normal operation of the wireline tool assembly;

FIGS. 5A and 5B are sectional views similar to that shown in FIGS. 4A and 4B, and showing the internal components of the wireline safety mechanism in the actuated positions thereof following severing of the wireline;

FIG. 6 is a sectional view taken along line 6—6 of FIG. 4B; and

FIG. 7 is a sectional view taken along line 7—7 of FIG. 4B.

DETAILED DESCRIPTION OF PREFERRED EMBODIMENT

Figure 1:
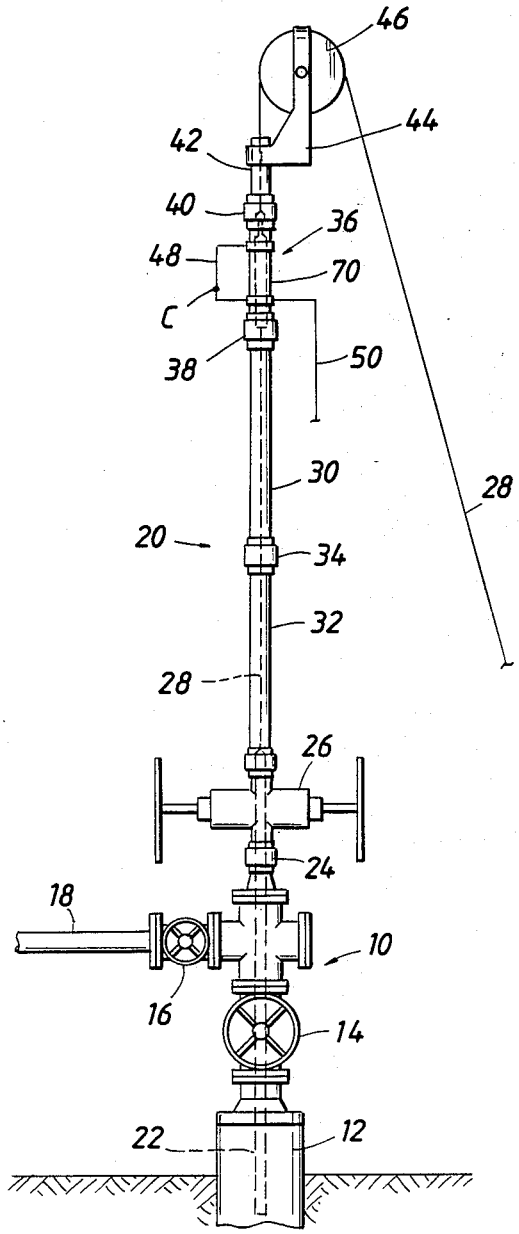

Referring now to the drawings and first to FIG. 1, a wellhead shown generally at 10 is connected to the upper extremity of well casing 12 and incorporates at least one safety valve 14 for the purpose of shutting in the well as desired. The wellhead is typically provided with at least one wing valve 16 that controls the flow of production fluid from the wellhead into a production line 18 extending to a suitable facility for receiving production fluid.

Under circumstances where wireline operations are to be conducted within the well a wireline tool assembly such as shown generally at 20 is connected to the upper portion of the wellhead assembly and is utilized to introduce a wireline tool string shown in broken lines at 22 into the well such that it passes through the wellhead assembly and into the production tubing that extends downwardly to the production zone being produced by the well. A typical wireline tool assembly such as that shown at 20 will be connected to the wellhead by means of a union 24 and will include a wireline blowout preventer 26 that includes two or more rams that are capable of achieving a seal about the wireline 28 that extends through the wireline tool assembly. Typically, a wireline tool assembly will incorporate upper and lower lubricators 30 and 32 that are interconnected by a lubricator union 34. A stuffing box is typically connected to the upper lubricator to provide a secure pressure containing seal about the wireline as it passes into and out of the wireline tool assembly.

According to the present invention a wireline cutter and safety mechanism shown generally at 36 is connected by a union 38 to the upper lubricator 30 and is provided with an upper union 40 that provides support for the stuffing box 42. The stuffing box assembly is provided with an external support member 44 that positions a rotatable pulley or sheave 46 to receive the wireline 28. The sheave allows the running portion of the wireline to extend downwardly to the wireline receiving winch of wireline handling equipment which can be mounted on a small truck or other vehicle or which can be provided on or adjacent the working floor of the drilling rig. The wireline safety mechanism of this invention incorporates an external equalizing line 48 for equalizing pressure across an internal valve mechanism as desired. The apparatus also includes an external hydraulic line 50 which extends from a pump or other source of pressurized hydraulic fluid to the wireline safety apparatus for actuation of the wireline cutting operation.

Figure 2:
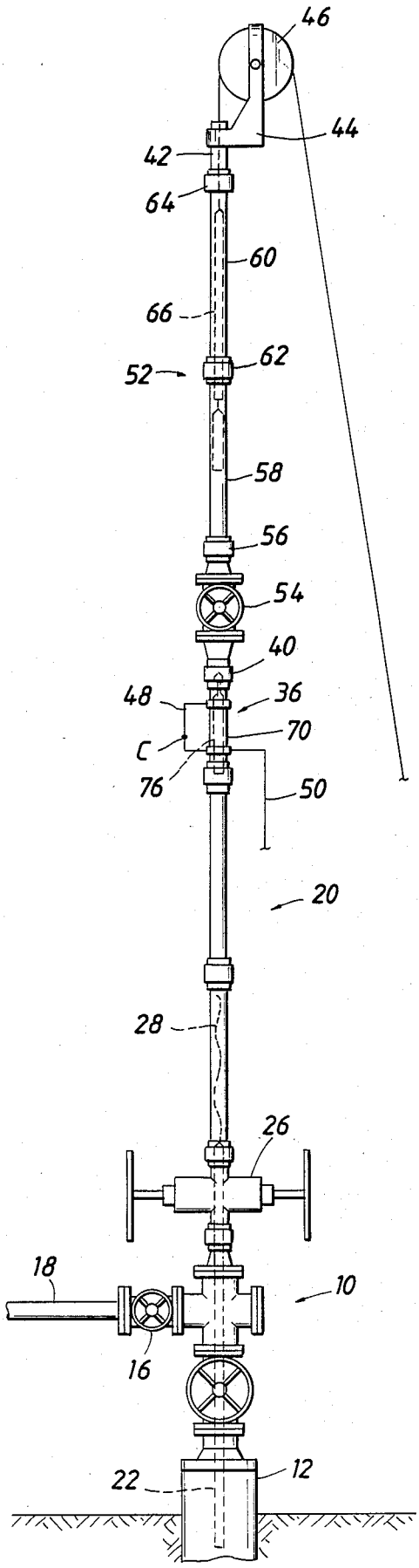

As shown in FIG. 2, a second wireline tool assembly shown generally at 52 is assembled to the upper portion of the wireline cutter and safety mechanism 36. This second wireline tool assembly incorporates a valve mechanism 54 such as a ball valve or gate valve which is utilized to provide a positive seal between the upper and lower wireline tool assemblies. The valve 54 is coupled to the wireline cutter and safety mechanism 36 by means of coupling 40 and employs a coupling 56 between the valve 54 and a lower lubricator 58. An upper lubricator 60 is coupled to the lower lubricator by a union 62 and is coupled with the stuffing box 42 or another stuffing box by means of a union 64.

Figure 3:
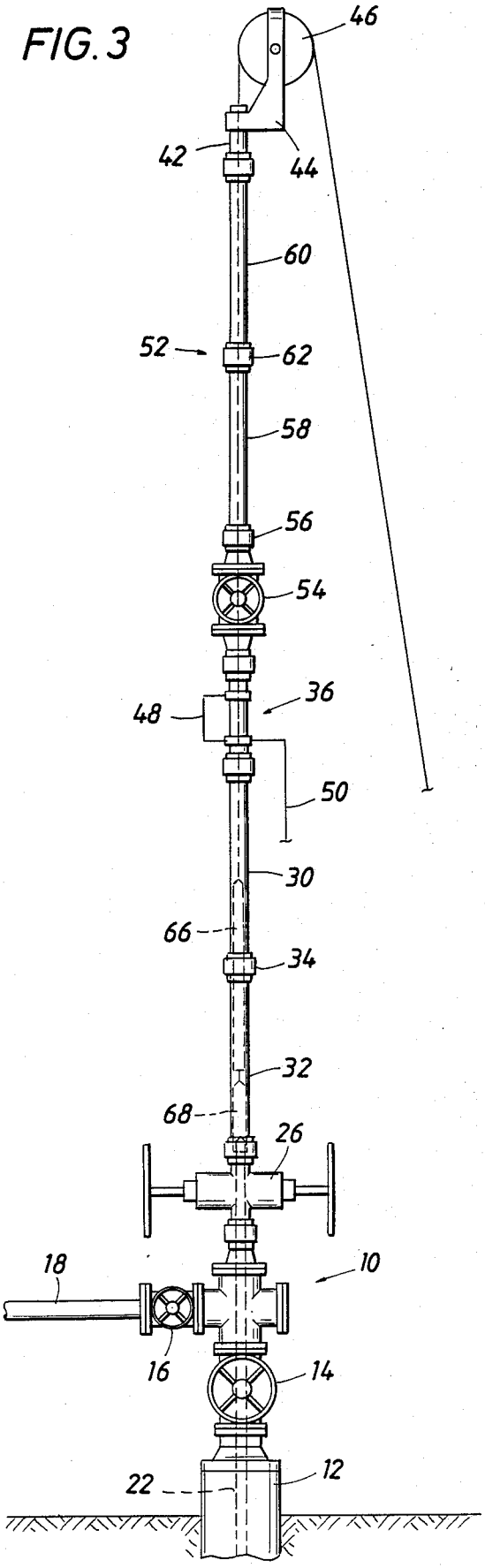
Figure 6:
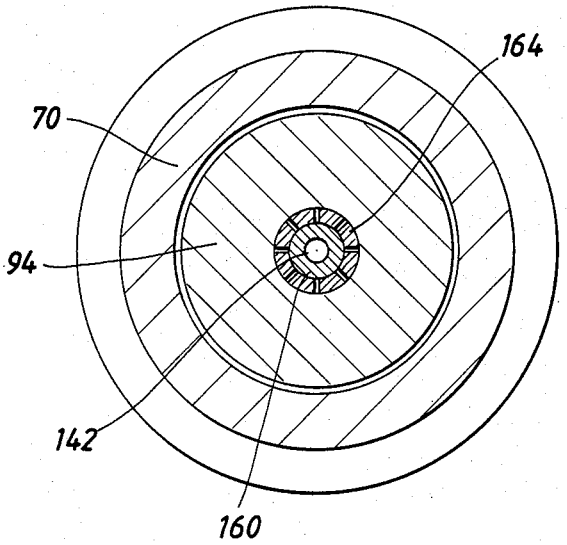
Figure 7:
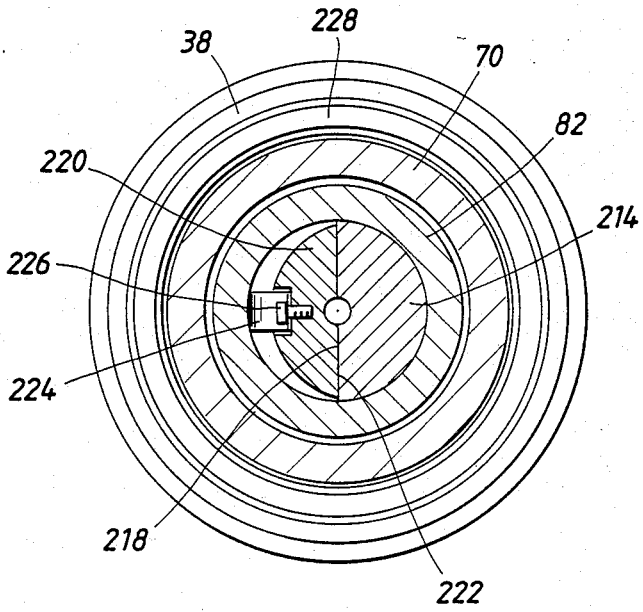

As shown in the elevational view of FIG. 3 by way of broken lines, the internal operating components of the wireline cutter and safety mechanism have been removed leaving an open tubular housing for passage of another wireline tool string 66 having a fishing tool 68 that is capable of latching onto and retrieving the released stuck wireline tool 22. The wireline tool string 66 may be in the form of a jarring mechanism capable of loosening the tool string 22 from its stuck condition.

Figure 4A:
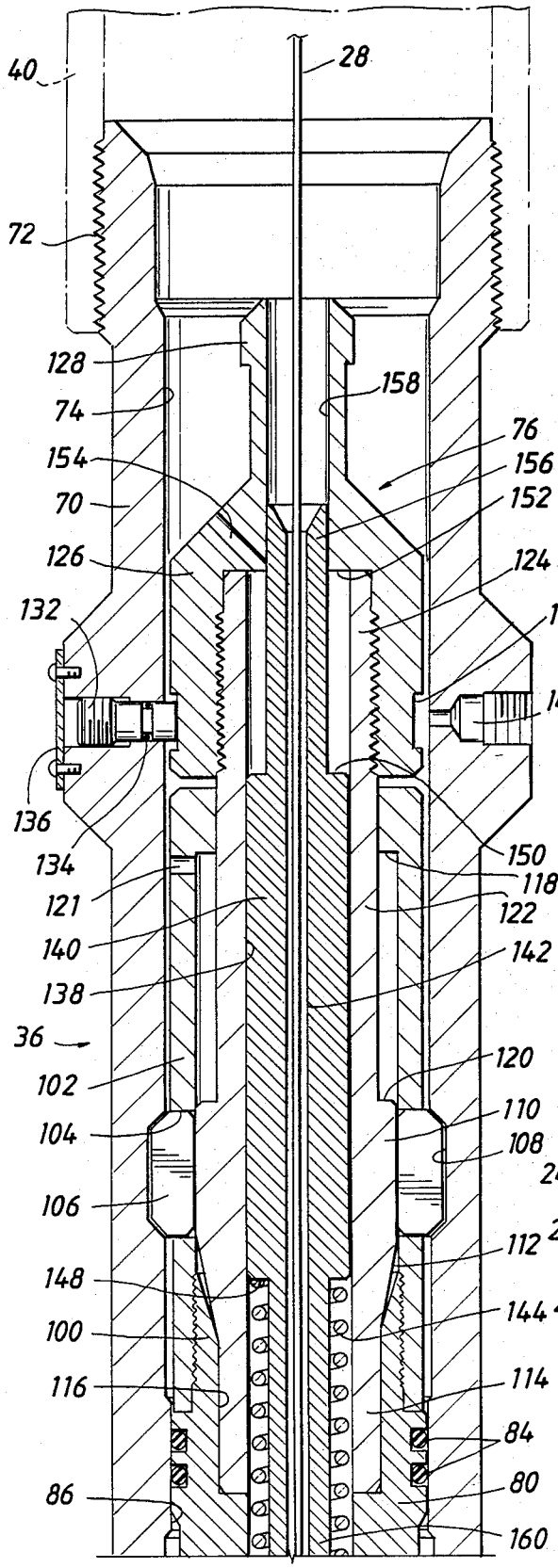
Figure 4B:
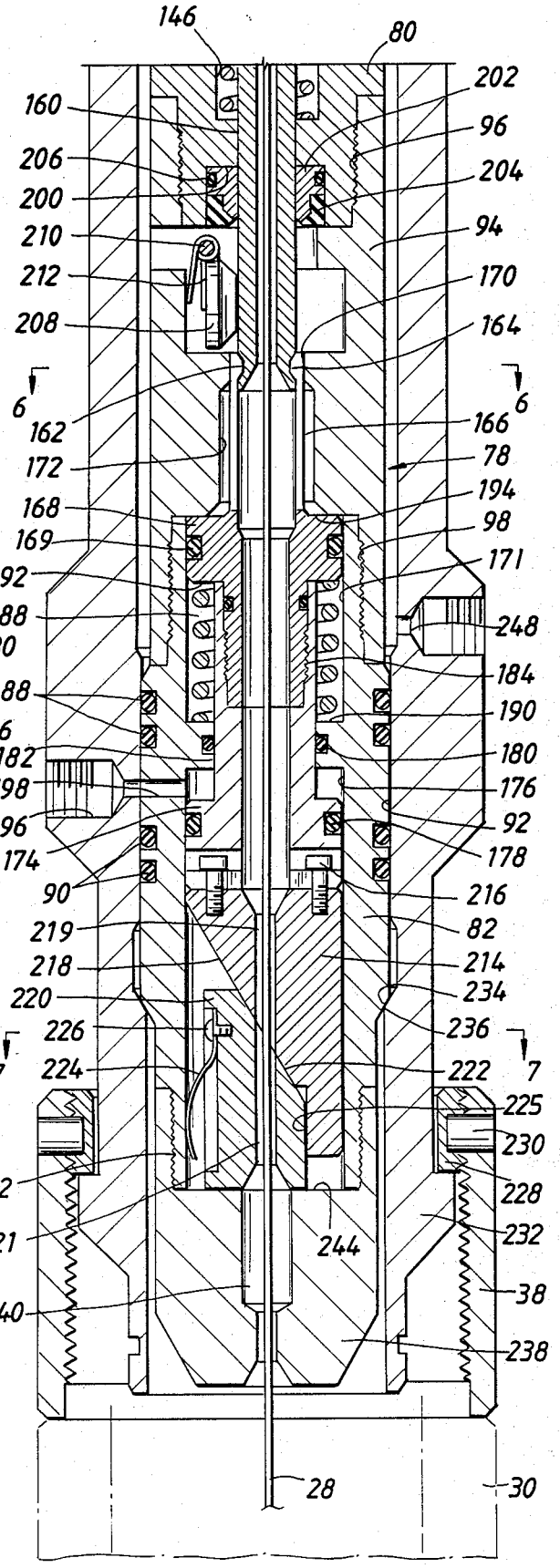

Referring now to the FIGS. 4A and 4B the wireline cutter drawings the wireline cutter and safety mechanism shown generally at 36 incorporates a tubular body structure 70 having its upper portion shown in FIG. 4A and its lower portion in FIG. 4B. The tubular body 70 forms an upper threaded section 72 which is capable of threadedly receiving a union connection shown in broken lines at 40 and shown in full line in FIG. 1. The tubular body 70 forms an internal passage 74 which is a straight through passage having a minimum internal dimension equal to or greater than the internal dimension of the lubricator risers of the wireline tool assembly so that downhole tools may be passed through the housing 70 if such becomes necessary or desirable. Within the tubular housing 70 is provided an inner housing in the form of a wire cutting and pressure sealing assembly shown generally at 76 which incorporates an elongated packoff sub shown generally at 78 which incorporates upper and lower sealing sections 80 and 82 respectively that establish spaced sealing engagement with internal sealing surfaces defined within the tubular housing. As shown in FIG. 4A the upper sealing section 80 of the packoff sub is provided with circular sealing elements 84 such as O-rings that establish sealing contact with an internal cylindrical sealing surface 86 of the housing 70. The lower sealing section 82 of the packoff sub incorporates spaced pairs of circular sealing elements 88 and 90 that establish sealing engagement with an internal cylindrical sealing surface 92 of the housing 70. The packoff sub also includes an intermediate valve section 94 having internally threaded extremities 96 and 98 that establish threaded connection with the respective upper and lower sealing sections 80 and 82.

The upper end of the upper sealing section 80 defines an externally threaded tubular connector 100 which is threadedly received by the internally threaded lower extremity of a tubular key retainer 102. The key retainer includes a plurality of receptacles 104 having locking key members 106 movably disposed therein. The key members are adapted to be received within a key recess 108 formed internally of the tubular body 70 for the purpose of latching the inner housing with its internal wire cutter and pressure sealing mechanism in movable relation within the tubular body. Within the tubular key retainer is movably positioned a tubular key expander 110 forming a tapered external cam surface 112 that engages and urges the key members 106 radially outwardly into locking relationship with the internal key recess 108 when the key expander is moved downwardly within the key retainer 102. As shown in FIG. 4A the key expander 110 is at its lowermost position relative to the packoff assembly, with the tubular nose portion 114 thereof received in seated engagement within an internal receptacle 116 defined Within the upper sealing section 80 of the packoff assembly. The upper limit of travel of the key expander is defined by an internal stop shoulder 118 of the key retainer which is disposed for engagement by an upwardly directed annular shoulder 120 formed by the key expander. To ensure against hydraulic locking or hydraulic retarding as the key expander is moved relative to the key retainer 102 a port 121 in the key retainer permits interchange of fluid. The key expander also incorporates a tubular connector 122 having an externally threaded upper extremity 124 that is received by the internal threads of a fishing neck 126. The fishing neck device 126 incorporates an upper fishing connector 128 enabling it to be grasped by a fishing tool such as is utilized to install and retrieve the wireline cutting and pressure sealing components of the wireline safety mechanism.

To maintain the latch or lock system safely in place the fishing neck 126 forms an external locking groove 130 that receives one or more locking screws 132 which are supported by the tubular housing 70. The locking screws 132 are threadedly received within respective bores formed in the housing and are sealed with respect to the housing by means of sealing elements 134. A cover plate 136 that is secured to the housing 70 prevents access to the locking screws until such time as it is desired to release the internal mechanism 76 from the tubular body 70. When this is desired, an Allen wrench or other suitable tool is utilized after removing the cover plate to unthread the locking screws and move them to a position releasing their connection with the looking groove 130. Although one such locking screw is shown in FIG. 4A it is to be understood that a plurality of locking screws may be employed to insure proper positioning of the internal components. These locking screws are not intended to restrain the internal components against well pressure and will not serve that function, but they restrain the fishing neck and inner sleeve from unintentional upward motion, and there by prevent accidental release of the locking mechanism.

The tubular key retainer 122 defines an internal passage 138 having a flow tube member 140 received in close fitting, movable relation therein. The flow tube 140 defines a longitudinal passage 142 which receives the wireline 28 in movable relation therein. The flow tube 140 is urged upwardly by means of a compression spring 144 having its lower end seated within a receptacle 146 of the upper sealing section 80. The upper end of the compression spring bears against a downwardly facing shoulder 148 of the flow tube. The extent of upward movement of the flow tube within the passage 138 occurs when an upwardly facing annular shoulder 150 of the flow tube moves into contact with a downwardly facing stop shoulder 152 formed within the fishing neck 126. To accommodate fluid displacement upon upward movement of the flow tube 140 within the passage 138 the fishing neck is provided with a bleed port 154 which communicates the passage 138 with the internal passage 74 of the housing 70. A flow tube extension 156 of reduced diameter is received within an internal passage 158 of the fishing neck 126.

Obviously the valve mechanism of the apparatus cannot form a seal while the wireline is in place. The valve could be damaged if it should attempt to close on the wireline. Accordingly, the mechanism incorporates a valve delay system which ensures that valve closure can occur only after the wireline has been cut and tension on the wireline causes it to be withdrawn from its valve interferring position. As shown at the lower portion of FIG. 4A and in 4B the valve delay is formed in part by the lower end of the flow tube 140 which forms a latch extension 160 which also serves as a guide for the compression spring 144. At its lower end the latch extension 160 defines a latch recess or profile 162 that receives the latching ends 164 of a plurality of collet fingers 166 that extend upwardly from the upper end of an upper piston member 168 having a piston seal 169 having sealing engagement with a cylindrical wall 171. In the position shown in FIG. 4B the collet fingers are restrained against spreading by means of a cylindrical surface 170 defined interiorly of the valve housing section 94. Upon downward movement of the collet assembly the interengaging relation between the collet latch elements 164 and the latch profile 162 of the flow tube extension 160 will cause the flow tube to move downwardly against the force of its compression spring 144. As soon as the upper ends of the collet latch elements come into registry with an annular internal enlargement 172 during such downward movement, a position at which the wireline cutter has already cut the wireline, the collet fingers will be spread by the camming activity that occurs as the collet fingers are forced downwardly against the latching profile 162. Spreading of the collet fingers causes the collet fingers to release the latching ends thereof from the latching profile, thus freeing the flow tube for upward movement under the influence of the compression spring. Downward movement of the collet fingers is caused by the action of hydraulic force against a hydraulically energized piston assembly including an upper piston 168 and a lower piston 174 that is movable within an internal cylinder 176 defined by the piston housing and lower sealing section 82 of the packoff assembly. The piston 174 is sealed with respect to the cylinder 176 by means of an O-ring seal 178 and also defines a spaced seal with the piston housing which is in the form of an O-ring seal 180 which is retained within a seal recess formed within a reduced diameter portion of the piston housing and which establishes sealing engagement with a cylindrical external sealing surface 182 defined by a reduced diameter upwardly extending portion of the piston 174. The piston sections 168 and 174 are interconnected by a threaded assembly 184. A piston return spring 186 is received within a spring chamber 188 with its lower end in force transmitting relation with a spring support shoulder 190. The upper end of the spring 186 bears against a lower shoulder 192 of the upper piston 168 and thereby functions to urge the piston assembly upwardly to a position where it is restrained by a downwardly facing annular shoulder 194 of the valve housing 94. The pistons are of identical dimension and are balanced with respect to well pressure such that the only force continuously acting on the piston is the force of the piston return spring 186.

The sealing elements 178 and 180 function as bridging seals to insure against leakage of hydraulic fluid from the cylinder 176. Hydraulic fluid is injected into the cylinder 176 for piston operation by conducting it from a hydraulic supply in connection with a hydraulic port 196 of the housing 70 and through a hYdraulic supply passage 198 into the hydraulic cylinder 176. The inner housing seals 88 and 90 prevent leakage of hydraulic fluid into the passage 74 of the tubular body 70. The source of pressurized hydraulic fluid may conveniently take the form of a hydraulic hand pump having a supply hose that is connected to the housing 70 at the port 196. The hand pump is then operated to inject hydraulic fluid into the cylinder 176 thus forcing piston 174 downwardly against the compression of its spring 186. The initial downward movement of the piston 174 induces cutting of the wireline 28 thus releasing the connection of the wireline with the stuck wireline tool string. Apparatus for severing the wireline will be discussed hereinbelow.

Figure 5A:
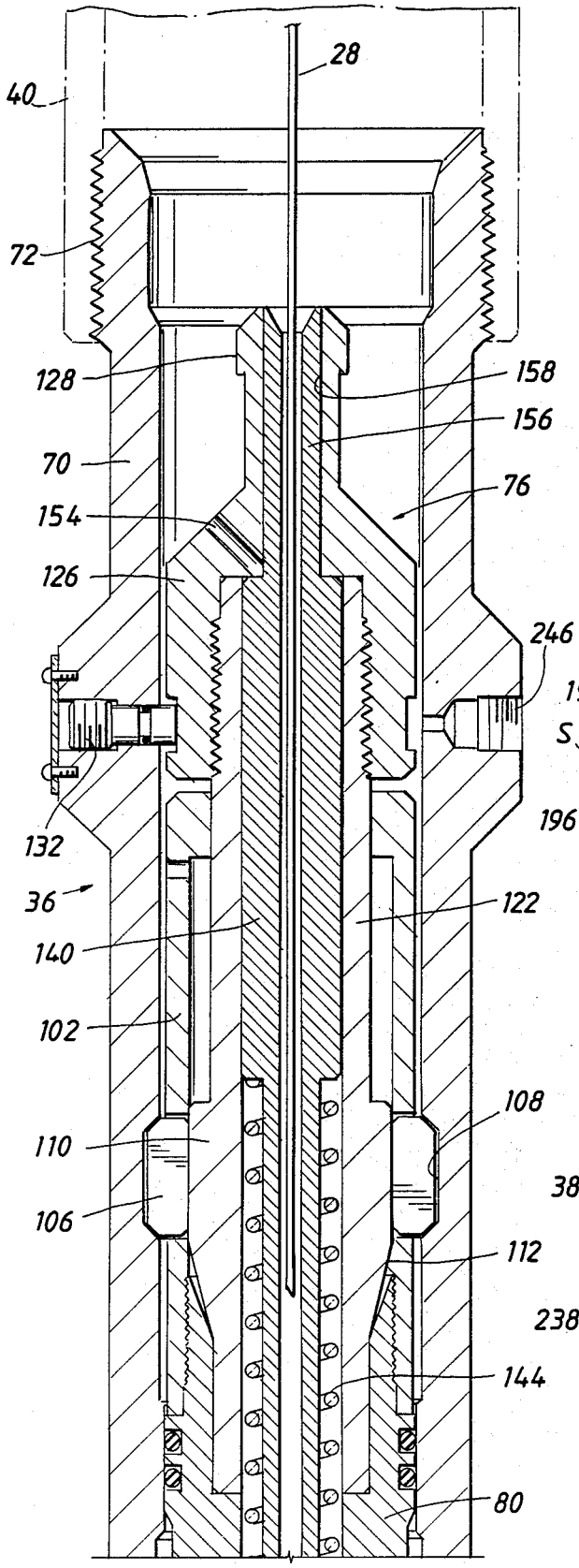
Figure 5B:
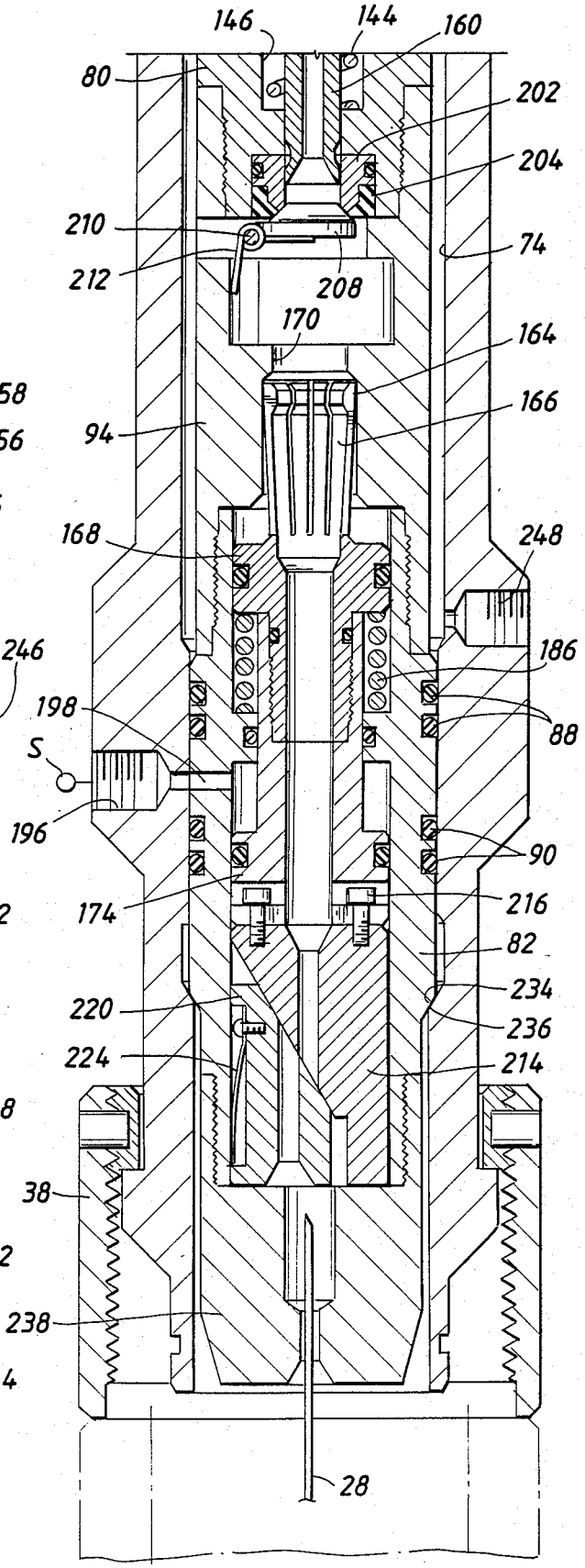

Further downward movement of the upper and lower pistons 168 and 174 causes further downward movement of the collet assembly 166 thus moving the collet assembly to a position releasing the restraining connection between the collet and the lower extension of the flow tube. This is accomplished as the upper latching portions of the collet fingers move into the annular enlargement 172 below the cylindrical restraining surface 170. When this occurs, the flow tube is driven upwardly by its compression spring to a position where its shoulder 150 comes into contact with the stop shoulder 152 of the fishing neck. When this sudden upward movement occurs the flow tube will clear its restraining relationship with a valve mechanism, allowing the valve mechanism to automatically close to thus establish a positive pressure containing seal that is capable of restraining well pressure. As shown in FIGS. 4B and 5B the sealing assembly may conveniently take the form of a flapper valve. It is to be born in mind, however, that any other suitable automatically closing valve mechanism may be employed in place of the flapper valve mechanism without departing from the spirit and scope of the present invention. The lower end of the upper sealing section of the inner housing or packoff sub defines a valve seat receptacle 200 which receives a valve seat assembly 202 having a seat retainer to which is fixed a resilient seat member 204. The valve seat assembly is sealed with respect to the upper sealing section by means of an O-ring seal 206. A flapper valve 20B is pivotally mounted within the valve housing 94 by means of a pivot pin 210 and is urged toward i&:s closed position by means of a torsion spring 212. The flapper valve is normally restrained in its open position by the extension 160 of the flow tube 140 and is automatically moved to a position where its tapered sealing surface establishes sealing engagement with the valve seat assembly when the flow tube has been retracted to the extent that its lower extension 160 is moved upwardly past the sealing portion of the valve seat assembly.

For achieving severing of the wireline, which is accomplished previous to valve closure 28 an upper shear wedge 214 is secured to the piston 174 by means of bolts 216 and defines a tapered shear face 218. The shear assembly incorporates a lower shear wedge 220 which defines a tapered surface 222 having mating engagement with tapered surface 218. As the upper shear wedge 218 is moved vertically by the piston 174 a camming activity occurs between the tapered surfaces 218 and 222, causing lateral movement of the lower shear wedge. The lower shear wedge is urged toward the upper shear wedge by means of a spring member 224 which is secured by screws 226 or by any other suitable means to the lower shear wedge 220. As the upper shear wedge is moved downwardly from the position of FIG. 4B to the position shown in FIG. 5B the wireline 28 will be sheared and the spring member 224 will become loaded to a greater extent. After the shearing activity has occurred and the piston assembly has been moved upwardly by its compression spring 186, the spring member 224 will urge the lower shear wedge from the position shown in FIG. 5B back to the position shown in 4B. In this position the lower shear wedge contacts an accurately machined datum face 225 which ensures the accurate registry of the shear passages 219 and 221 and prevents the shear from damaging a wireline until shearing activity occurs.

The lower union collar 38 has an annular internal shoulder 228 threadedly positioned therein and restrained by pin members 230. For assembly of the housing 70 to the upper end of an upper lubricator 30, the internal shoulder member 228 bears against an annular flange 232 formed at the lower portion of the housing. Inwardly of the lower portion of the tubular is defined a tapered shoulder 234 which may be defined as a "no go" shoulder and which is engaged by a correspondingly tapered surface 236 formed at the lower portion of the lower seal section of the packoff assembly. When the packoff assembly is moved downwardly to its full extent, shoulders 234 and 236 are brought into engagement, thereby limiting further downward movement. In this position the hydraulic fluid passage 198 and the hydraulic port 196 are brought into registry and the locking keys 106 of the locking mechanism are positioned in registry with the key recesses 108. Likewise, when the key expander 110 is shifted downwardly to the position urging the keys 106 into the key recess 108, thus latching all of the internal components in place within the housing 70, the annular locking groove 130 of the fishing neck 126 will be positioned in registry with the locking screws 132. The locking screws then may be moved to the position shown in FIG. 4A to restrain the fishing neck 126 from upward movement and thus also restrain the key expander 110 in the position securing the keys 106 in the locked positions thereof with respect to the locking recess 108.

The lower portion of the shear housing is defined by a bottom nose member 238 which forms a wireline passage 240 and which establishes a threaded connection 242 with a lower externally threaded extension formed at the lower end of the lower sealing section 82. The nose section 238 forms a planar internal surface 244 which provides for support of the lower shear wedge 220.

After the mechanism has been activated by introduction of pressurized hydraulic fluid into the cylinder 176 thus forcing the piston downwardly to shear the wireline and release the collet connection with the flow tube and allow automatic closure of the flapper valve, it will subsequently be appropriate to establish a pressure balanced condition across the flapper valve to permit removal of the wireline shear and pressure sealing assembly. To accomplish such pressure balancing the housing 70 is provided with upper and lower pressure equalizing ports 246 and 248 which are in the form of internally threaded connections. A pressure equalizing line such as shown at 48 in FIGS. 1–3 is interconnected with the housing 70 at the upper and lower equalizing ports, thus providing a pressure equalizing bridge across the seal of the flapper valve. This pressure equalizing line will be provided with a control valve C which is normally closed to render the seal of the flapper valve effective. When it is desired to remove the internal shear and pressure sealing components of the mechanism after a second wireline tool assembly has been installed as shown in FIGS. 2 and 3, the control valve C will be opened. In the pressure balanced condition of the apparatus, the internal wire cutting and pressure sealing components may be released and withdrawn by means of an appropriate release tool controlled by the upper wireline tool assembly.

OPERATION

When wireline operations are to be conducted for the handling of downhole well activities, the wireline assembly installation will be essentially as set forth in FIG. 1 with a wireline blowout preventer being connected to the upper extremity of the wellhead 10. The wireline assembly will incorporate upper and lower lubricator risers such as shown at 30 and 32 with the wireline cutting and pressure sealing assembly 36 of the present invention mounted immediately above the upper lubricator. The stuffing box of the wireline tool assembly will be connected to the upper end of the housing 70 in the manner shown in FIG. 1.

Assume that the wireline tool string 22 has become stuck in the position shown in broken lines in FIG. 2 and it can not be released by conventional jarring activities, the apparatus of the present invention will be employed to cut the wireline and establish a pressure seal to permit a second wireline assembly and a shut-off valve to be installed above it in the manner shown in FIG. 2. To accomplish this activity the control valve C of the pressure equalizing line 48 is checked to insure that it is closed. The discharge line of a hydraulic pump such as a hydraulic hand pump is then connected to the housing 70 at the hydraulic port 196 and is activated to inject hydraulic fluid under pressure into the cylinder 176. The pressurized hydraulic fluid acts upon the piston 174 urging it downwardly against the compression of piston spring 186 and simultaneously imparting downward movement to the upper piston 168 and its collet fingers 166 along with the flow tube 140. Initial downward movement of the piston 174 causes consequent downward movement of the upper shear wedge 214 causing shearing of the wireline 28 to release the running portion of the wireline from the stuck wireline tool string. The running portion of the wireline is then removed from the wireline passage of the apparatus at least to a level above the sealing portion of the valve seal. Further downward movement of the piston 174 under the influence of hydraulic pressure moves the collet fingers downwardly until the latch extremities 164 thereof move into the annular recess 172. When this occurs the collet fingers will spread thereby releasing the connection thereof with the lower extension 160 of the flow tube 140. Upon release of the flow tube, the flow tube spring 144 urges the flow tube upwardly retracting the lower extension of the flow tube upwardly through the valve seat assembly. When this occurs the flapper valve 208 will be forced by its spring 212 into sealing engagement with the metal and elastomer seat assembly. In this condition the wireline has been sheared to release the stuck wireline tool string and the valve has closed thereby establishing a pressure containing seal below the level of the stuffing box 42. The pressure between the closed valve and the stuffing box may be bled to atmosphere and the stuffing box may then be removed simply by releasing its union connection. Thereafter, the second wireline assembly 52 with its control valve 54 may be installed to the upper end of housing 70 in the manner shown in FIG. 2.

In order to run another wireline tool string through the wireline apparatus shown in FIGS. 2 and 3, it will be appropriate to remove the wireline cutting and pressure sealing assembly contained within the inner housing or packoff assembly. This is accomplished after the upper wireline tool assembly is in place by opening the control valve C of the pressure equalizing line 48 thereby allowing well pressure to become balanced across the closed flapper valve 208. At this time, well pressure is controlled by the upper wireline assembly. Another wireline tool string shown in broken lines at 66-68 incorporating a wireline pulling tool is extended downwardly into contact with the fishing neck extension 128.

In order to allow release of the locking mechanism it is first necessary to retract the locking screws and release the fishing neck for upward movement. This is accomplished by first removing the cover plate 136 and by utilizing an Allen wrench or other suitable tool to retract the locking screws 132. After the fishing neck 126 has been released, the wireline tool string 166 is activated to move the fishing neck 126 upwardly. When this occurs the key expander 110 is also moved upwardly thus releasing the locking keys 106 and allowing them to move radially inwardly, retracting them from the locking recess 108. After this has occurred continued upward movement of the wireline tool string will cause the inner housing with all of the internal components of the wireline cutting and pressure sealing mechanism to be withdrawn upwardly into the lubricator risers of the upper wireline assembly. After this has been done, the pressure control valve 54 will be closed and the upper wireline tool assembly will be released to permit the wireline cutting and pressure sealing assembly to be removed from it. Following such removal another wireline tool string incorporating a jarring mechanism, a fishing tool and other suitable apparatus will be positioned within the lubricator risers. The upper wireline tool assembly will then be reassembled to the upper end of the valve 54. The valve then may be opened to allow the wireline tool string to descend downwardly to the level of the stuck wireline tool string to thereby accomplish its release. The previously stuck wireline tool string then may be removed upwardly into the wireline tool assemblies for removal, or if such upward movement is impossible, it may be lowered downwardly, permitting closure of the blowout preventer rams. Thereafter, other well service activities may be conducted to remove the previously stuck wireline tool string.

After the wireline tool string has been unstuck and removed, if wireline service operations are to continue, the wireline cutter and pressure sealing mechanism may be reinstalled within the wireline tool assembly. For reinstallation, the mechanism 76 must be reset to the condition shown in FIGS. 4A and 4B with the latch elements 164 of the collet fingers 166 in engagement with the latch recess of the flow tube extension 160. In this condition, the fishing neck 126 of the apparatus is connected to a fishing tool of the second wireline tool assembly 52 and is lowered into the tubular body 70 to such extent that the tapered shoulder 236 of the interhousing comes into contact with the internal tapered shoulder 234 as shown in FIG. 4B. When so positioned the hydraulic supply passage 198 will be in registry with the hydraulic inlet 196 so that the piston operating system for the shear and valve release mechanisms will be operative. Also the locking keys 106 will be in registry with the locking recess 108 of the tubular body 70. When the apparatus is being lowered the fishing neck 126 and the key expander 110 will be moved upwardly to such extent that shoulders 118 and 120 will be in engagement. The locking keys will be retracted to the release positions thereof where they may engage the lower portion 114 of the expander 110. Thereafter the fishing neck 126 and the expander 110 will be moved downwardly, causing the tapered external cam surface 112 of the expander to urge the locking keys 106 radially outwardly into locking engagement within the locking recess 108. Downward movement of the expander continues until the large diameter cylindrical retainer portion thereof is seated behind the keys in the manner shown in FIG. 4A. In this position the fishing neck 126 will be located as shown in FIG. 4A causing the locking groove 130 to be positioned in registry with the locking screws 132. The locking screws will then be threaded inwardly to the locking position shown in FIG. 4A. Thereafter, the cover plate 136 is then installed to complete the reinstallation procedure.

The upper wireline tool assembly 52 and its control valve is then removed by releasing the union 40 and the stuffing box 42 is then installed to the position shown in FIG. 1. The wireline tool assembly 20 may then be placed into service in the same manner as shown in FIG. 1.

In view of the foregoing, it is seen that this invention is well adapted to attain all of the objects and advantages hereinabove set forth together with other advantages which will become obvious and inherent from a description of the apparatus itself. It will be understood that certain combinations and subcombinations are of utility and may be employed without reference to other features and subcombinations. This is contemplated by, and is within, the scope of the present invention.

As many possible embodiments may be made of this invention without departing from the spirit or scope thereof, it is to be understood that all matters hereinabove set forth or shown in the accompanying drawings are to be interpreted as illustrative and in a limiting sense.

We claim:

1. A wireline safety mechanism for wireline assemblies comprising:

(a) a tubular body adapted for connection in a wireline assembly and receiving a wireline therethrough;

(b) a cutter actuator being movably disposed within said tubular body;

(c) a wireline cutter being movably positioned within said tubular body and being operatively interconnected with said cutter actuator, whereby predetermined movement of said cutter actuator induces said wireline cutter to sever the wireline extending through said wireline assembly;

(d) means for selectively inducing said predetermined movement of said cutter actuator; and (e) locking means releasably retaining said wireline cutter and said cutter actuator within said tubular body, said locking means being releasable from said tubular body to permit a wireline tool string to be passed through said tubular body.

2. A wireline safety mechanism as recited in claim 1, including (a) valve means being movably positioned within said tubular body and normally being maintained in the open position thereof; and (b) delay means for causing closing movement of said valve means during said predetermined movement of said cutter actuator and after cutting of said wireline.

3. A wireline safety mechanism as recited in claim 1, wherein:

said wireline cutter is a shear mechanism.

4. A wireline safety mechanism as recited in claim 3, wherein:

(a) an inner piston housing is removably retained within said tubular body and forms a piston chamber; and (b) said cutter actuator is a piston disposed in movable sealed relation within said piston chamber and having driving relation with said shear mechanism.

5. A wireline safety mechanism as recited in claim 1, including:

(a) inner housing means being releasably retained within said tubular body and forming a piston chamber;

(b) a piston member being movable in one direction within said piston chamber under the influence of fluid pressure and being urged in the opposite direction;

(c) said wireline cutter being in driven relation with said cutter actuator and accomplishing cutting of said wireline upon movement of said cutter actuator in said one direction;

(d) valve means being movably disposed within said inner housing means and being normally open to communicate fluid pressure through said inner housing means, said valve means upon closing, establishing a pressure containing seal within said inner housing means; and (e) valve retainer means being movable within said inner housing means and normally retaining said valve means at the open position thereof, said valve retainer means being automatically movable to a valve releasing position responsive to predetermined movement of said piston means in said one direction such that valve closure occurs after cutting of said wireline.

6. A wireline safety mechanism as recited in claim 5, including:

(a) a flow tube being linearly movable within said inner housing means and being positionable to retain said valve means in the open position thereof and being movable to a position releasing said valve means for closure; and (b) releasable connector means establishing a releasable connection between said flow tube and said piston member, said releasable connector means restraining said flow tube against movement while connected therewith and releasing said flow tube upon predetermined movement of said piston in said one direction.

7. A wireline safety mechanism as recited in claim 6, wherein said releasable connector means comprises:

(a) a latch recess being defined by said flow tube;

(b) collet means defining a plurality of collet fingers extending from said piston and forming latch elements at the extremities thereof, said latch elements being received within said latch recess to retain said collet means in assembly with said flow tube, said collet fingers being yieldable to release said latch elements from said latch recess; and (c) a locking surface defined within said inner housing means and retaining said latch elements within said latch recess when said flow tube and collet are in the latching positions thereof.

8. A wireline safety mechanism as recited in claim 1, wherein said locking means comprises:

(a) a key recess being formed within said tubular body;

(b) a plurality of locking keys being movably retained by said inner housing means and being movable from a locking position where said locking keys are received within said key recess to a release position where said locking keys are retracted from said key recess; and (c) a key expander being movably positioned within said inner housing means and being movable between a locking position securing said locking keys within said key recess and a retracted position permitting movement of said locking keys from said key recess, said key expander forming a cam surface for engaging said locking keys and moving said locking keys from said retracted position to said locking position.

9. A wireline safety mechanism as recited in claim 8, including:

a fishing neck being fixed to said key expander to facilitate movement of said key expander for locking and unlocking movement thereof by means of a wireline tool.

10. A pressure containing wireline safety mechanism for wireline assemblies having a stuffing box, at least one lubricator an a wireline for lowering and raising a wireline tool string in the tubing of a well, comprising:

(a) a tubular body adapted for connection in a wireline assembly above the lubricator and below the stuffing box and receiving the wireline therethrough;

(b) inner housing means being removably positioned in sealed relation within said body and having a valve seat therein;

(c) a valve element being movably connected to said inner housing means and being movable between open and closed positions relative to said valve seat:

(d) a valve release element being movably positioned within said inner housing means and normally retaining said valve element in the open position thereof and being movable to a release position releasing said valve element for closure thereof;

(e) means inducing closure of said valve element;

(f) actuator means being movably disposed within said inner housing;

(g) connector means establishing a releasable connection between said valve release means and said actuator means;

(h) a wireline cutter being movably positioned within said inner housing means and having a part thereof interconnected in driven relation with said actuator means, whereby predetermined movement of said actuator means induces said wireline cutter to sever the wireline extending through said wireline assembly; and (i) means for selectively inducing said predetermined movement of said actuator.

11. A pressure containing wireline safety mechanism as recited in claim 10, wherein said valve release element comprises:

(a) an elongated flow tube having a part thereof normally extending through said valve seat in the valve engaging position thereof and maintaining said valve in the open position thereof; and (b) means urging said flow tube to a release position where said part is moved clear of said valve element, thus allowing said valve element to establish sealing engagement with said valve seat.

12. A pressure containing wireline safety mechanism as recited in claim 11 wherein said connector means comprises:

(a) a latch recess being defined by said elongated flow tube;

(b) collet means extending from said actuator means and defining a plurality of resilient collet fingers each having latch means formed thereon, said latch means normally engaging within said latch recess of said flow tube restraining said flow tube at said valve engaging position; and (c) collet locking means being defined within said inner housing means and normally maintaining said latching elements securely locked within said latch recess.

13. A pressure containing wireline safety mechanism as recited in claim 10 wherein said actuator means comprises:

(a) a cylinder being defined within said inner housing means;

(b) piston means having a pressure responsive portion thereof disposed within said cylinder and being movable in one direction by the force of hydraulic pressure within said cylinder for actuation of said wireline cutter to cut said wireline;

(c) means urging said piston means in the opposite direction; and (d) hydraulic passage means receiving pressurized hydraulic fluid from a hydraulic fluid supply source and communicating said pressurized hydraulic fluid with said cylinder for actuation of said piston means in said one direction.

14. A pressure containing wireline safety mechanism as recited in claim 13, wherein said wireline cutter comprises:

(a) a first shear body being movably disposed within said inner housing means and having a first wireline passage therethrough, said first shear body being connected in driven relation to said piston means and forming an inclined shear face; and (b) a second shear body being laterally movable within said inner housing means and forming a second wireline passage for registry with said wireline passage of said first shear body, said second shear body forming an inclined shear face for mating engagement with said inclined shear face of said first shear body, upon movement of said first shear body in said one direction by said piston means, said second shear body being moved laterally by said inclined shear surface of said first shear body and moving said first and second wireline passages out of registry thus causing shearing of the wireline extending therethrough.

15. A pressure containing wireline safety mechanism as recited in claim 14, including:

means urging said second shear body toward a position bringing said first and second wireline passages into accurate registry.

16. A pressure containing wireline safety mechanism as recited in claim 10, including:

means releasably locking said inner housing means within said tubular body and being releasable to permit removal of said inner housing means from said tubular body, thus leaving said tubular body clear of any obstructions to permit passage of wireline tools therethrough.

17. A pressure containing wireline safety mechanism as recited in claim 11 wherein said releasable locking means comprises:

(a) a key recess being defined within said tubular body;

(b) a plurality of locking keys being movably supported by said inner housing means and being movable to locking positions within said key recess for locking said inner housing means in immovable relation within said tubular body, said plurality of locking keys being movable from said locking positions to retracted positions releasing said inner housing means from said tubular body to permit withdrawal of said inner housing means from said tubular body; and (c) a key expander being movably disposed within said inner housing means and being positionable to secure said locking keys in said locking positions thereof, said key expander being lineraly movable to a position releasing said locking keys and permitting movement thereof to said retracted positions.

18. A pressure containing wireline safety mechanism as recited in claim 17, wherein:

(a) said key expander forms a tapered external cam surface disposed for camming engagement with said plurality of locking keys upon movement of said key expander in one linear direction thereof; and (b) a fishing neck being secured to said key expander, thus permitting movement of said key expander by a wireline tool.

19. A pressure containing wireline safety mechanism as recited in claim 18, including:

second lock means being retained by said tubular body and being selectably positionable to establish locking engagement with said fishing neck, thus preventing movement of said fishing neck and said key expander until retraction of said inner body means from said tubular body is intended.

20. A wireline cutter and pressure seal assembly for a wireline lubricator adapted to receive a wireline in movable, sealed relation therethrough, comprising:

(a) housing means forming a shear and piston chamber;

(b) a first shear element forming a first shear edge and being transversely movable within said shear chamber and forming a first tapered surface;

(c) means normally positioning said first shear element at a position within said internal shear chamber for permitting restricted movement of said wireline relative thereto;

(d) a second shear element forming a second shear edge and being linearly movable within said internal shear chamber and forming a second tapered surface having camming engagement with said first appeared surface and interacting during predetermined linear shearing movement of said second shear element to impart said lateral movement to said first shear element and to cause shearing of said wireline by said first and second shear edge;

(e) a piston member being movable within said housing and disposed in driving relation with said second shear element, said piston member being movable linearly responsive to selective introduction of fluid pressure into said piston chamber;

(f) valve means disposed within said housing and being normally maintained in the open position thereof; and (g) delay means for causing closing movement of said valve means for sealing of said housing means after shearing of said wireline by said first and second shear edges.

21. The wireline cutter and pressure seal assembly of claim 20, wherein said delay means comprises:

(a) a flow tube being linearly movable within said inner housing means and being positionable to retain said valve means in the open position thereof and being movable to a position releasing said valve means for closure; and (b) releasable connector means establishing a releasable connection between said flow tube and said piston member, said releasable connector means restraining said flow tube against movement while connected therewith and releasing said flow tube upon predetermined movement of said piston in said one direction.

22. The wireline cutter and pressure seal assembly of claim 21, wherein said releasable connector means comprises:

(a) a latch recess being defined by said flow tube;

(b) collet means defining a plurality of collet fingers extending from said piston and forming latch elements at the extremities thereof, said latch elements being received within said latch recess to retain said collet means in assembly with said flow tube, said collet fingers being yieldable to release said latch elements from said latch recess; and (c) a locking surface defined within said inner housing means and retaining said latch elements within said latch recess when said flow tube and collet means are in the latching positions thereof.

23. The wireline cutter and pressure seal assembly of claim 20, wherein:

(a) said first and second shear elements each form wireline passages which are normally in registry; and (b) said second shear element forms a positioning surface which, when engaged by said first shear element, establishes registry of said wireline passage of said first and second shear element.

* * * * *